US008617379B2

(12) United States Patent
Wong et al.

(10) Patent No.: US 8,617,379 B2
(45) Date of Patent: Dec. 31, 2013

(54) ELECTROPOLISHING SOLUTION CONTAINING A SULFATE SALT AND METHODS OF USE THEREOF

(75) Inventors: Sophia L. Wong, Milpitas, CA (US); William E. Webler, San Jose, CA (US)

(73) Assignee: Abbott Cardiovascular Systems, Inc., Santa Clara, CA (US)

( * ) Notice: Subject to any disclaimer, the term of this patent is extended or adjusted under 35 U.S.C. 154(b) by 147 days.

(21) Appl. No.: 13/271,501

(22) Filed: Oct. 12, 2011

(65) Prior Publication Data

US 2013/0092556 A1 Apr. 18, 2013

(51) Int. Cl.

| | |
|---|---|
| ***C25F 3/16*** | (2006.01) |
| ***C25F 7/02*** | (2006.01) |
| ***C25B 15/00*** | (2006.01) |

(52) U.S. Cl.

USPC ..... 205/673; 205/675; 205/678; 204/232

(58) Field of Classification Search

USPC ..... 205/640–686; 204/232–241

See application file for complete search history.

(56) References Cited

U.S. PATENT DOCUMENTS

| | | | | |
|---|---|---|---|---|
| 6,375,826 | B1 * | 4/2002 | Wang et al. | 205/684 |
| 7,771,581 | B2 * | 8/2010 | Callol et al. | 205/640 |
| 2013/0092554 | A1 | 4/2013 | Wong et al. | |
| 2013/0092557 | A1 | 4/2013 | Wong et al. | |

FOREIGN PATENT DOCUMENTS

SU 338556 A * 4/1973

* cited by examiner

*Primary Examiner* — Nicholas A Smith
*Assistant Examiner* — Brian W Cohen
(74) *Attorney, Agent, or Firm* — Workman Nydegger; John Kwok

(57) ABSTRACT

A substantially anhydrous electropolishing electrolyte solution that includes at least one sulfate salt. The substantially anhydrous electropolishing electrolyte solutions described herein do not use water as a solvent; instead, such electropolishing electrolyte solutions use anhydrous alcohols and/or glycols as a solvent. For example, an electropolishing electrolyte solution, as described herein, may include an alcohol, at least one mineral acid, and at least one sulfate salt. The at least one sulfate salt can act as a source of sulfate ions to replenish sulfate ions consumed in the electropolishing process. Anhydrous sulfate salts can also act as water scavengers by reacting with water to form sulfate salt hydrates. Methods of electropolishing metal articles using such electropolishing electrolyte solutions are disclosed herein as well.

14 Claims, 3 Drawing Sheets

ELECTROPOLISHING SOLUTION CONTAINING A SULFATE SALT AND METHODS OF USE THEREOF

BACKGROUND

The present disclosure relates generally to electrolyte solutions that can be used for electropolishing articles made from metals, and in particular, for electropolishing metallic medical devices (e.g., stents, closure devices, and the like) made of stainless steel, titanium, tungsten, nickel-titanium, tantalum, cobalt-chromium-tungsten, tantalum-nickel-tungsten, etc. While the electrolyte solutions described herein are mainly applicable to metallic medical devices, the disclosure is not limited to such medical devices. For example, the methods may be applied to electropolish metallic automotive or aerospace components.

Electropolishing is an electrochemical process by which some of the surface metal is electrolytically dissolved. In general, the metal article (e.g., a stent) is connected to an anode and connected to a power supply while immersed in an electrolyte solution. A metal cathode connected to the negative terminal of the power supply is also included in the electrolyte solution. Metal is removed from the anode surface by the action of the current and the electrolyte solution as current flows from the metal article (as the anode) to the cathode. The rate at which metal is dissolved from the metal article is controlled, at least in part, by the applied current and/or voltage, the positioning of the cathode relative to the metal articles, and/or distribution of the electrolyte around the article. According to the theory of electropolishing, the current density is highest at high points protruding from a surface and is lowest at the surface low points. Thus, the higher current density at the raised points causes the metal to dissolve faster at these points which thus levels the surface.

Stents are generally tube-shaped intravascular devices placed within a blood vessel to maintain the patency of the vessel and, in some cases, to reduce the development of restenosis. Stents may be formed in a variety of configurations which are typically expandable since they are delivered in a compressed form to the desired site. Example stent designs include, but are not limited to, helically wound wire, wire mesh, weaved wire, serpentine stent, a chain of rings, or laser cut tubular stents. The walls of stents are typically perforated in a framework design of wire-like connected elements or struts or in a weave design of cross-threaded wire. Some stents are made of more than one material. The stent may be, for example, a sandwich of metals having outer layers of a biocompatible material, such as stainless steel, with an inner layer providing the radioopacity to the stent needed for tracking by imaging devices during placement. In forming such stents from metal, a roughened outer surface of the stent may result from the manufacturing process (e.g., from processes such as tube drawing and laser cutting).

It is desirable for the surface of the stent to be smooth so that it can be easily inserted and traversed with low friction through the blood vessels toward the site of implantation. In addition, a rough outer surface may also damage the lining of the vessel wall during insertion. Furthermore, smooth surfaces decrease the probability of thrombogenesis and corrosion. Likewise, stents having a smooth, mirror-like finish generally have a better fatigue life because surface defects (scratches, burrs, inclusions, and the like) can be sites for crack propagation.

Since the processing to form metallic stents often results in a product initially having undesirable burrs, sharp ends or debris and slag material from melting the metal during processing, mechanical cleaning (e.g., interior and exterior grinding), chemical cleaning (e.g., descaling), or the like are generally performed. Following cleaning, further surface treatment such as electropolishing is generally performed. Electropolishing is able to provide a mirror-like, defect-free surface to the metal article (e.g., the stent).

BRIEF SUMMARY

The present disclosure relates to a substantially anhydrous electropolishing electrolyte solution that includes at least one sulfate salt (e.g., a metal sulfate salt). Methods of electropolishing metal articles using such electropolishing electrolyte solutions are disclosed herein as well. The substantially anhydrous electropolishing electrolyte solutions described herein do not use water as a solvent; instead, such electropolishing electrolyte solutions use anhydrous alcohols, glycols, and the like as a solvent. For example, an electropolishing electrolyte solution, as described herein, may include an alcohol, at least one mineral acid, and at least one sulfate salt. In one embodiment, the sulfate salt is capable of replenishing sulfate ions that are consumed during the electropolishing process. In a related embodiment, the sulfate salt may be an anhydrous metal sulfate salt that is capable scavenging water from the electropolishing electrolyte by reacting with the water to form a metal sulfate hydrate. Such a metal sulfate hydrate may also being capable of replenishing sulfate ions. Such electropolishing electrolyte solutions and methods employing such electropolishing solutions may yield better electropolishing efficiency for a given voltage and current, increased longevity of the electropolishing electrolyte solution, and electropolished metal articles having substantially improved surface quality and uniformity.

In one embodiment, an electropolishing electrolyte solution is described. The electropolishing electrolyte solution, which is at least initially substantially anhydrous, includes an alcohol, at least one mineral acid, and at least one sulfate salt. In one embodiment, the mineral acid solution of the electropolishing electrolyte solution includes about 5 volume % ("vol %") to about 7 vol % sulfuric acid and about 3 vol % to about 14 vol % methanolic hydrochloric acid. In one embodiment, the alcohol is anhydrous (i.e., 100% or absolute) methanol. One will appreciate, however, that other alcohols, glycols, and the like may be substituted for or used in combination with methanol. Suitable examples of alcohols and glycols include, but are not limited to, ethanol, isopropanol, ethylene glycol, and propylene glycol. Suitable examples of sulfate salts include, but are not limited to, ammonium sulfate ("$(NH_4)_2SO_4$"), sodium sulfate ("$Na_2SO_4$"), zinc sulfate ("$ZnSO_4$"), potassium sulfate ("$K_2SO_4$"), and magnesium sulfate ("$MgSO_4$").

In the process of electropolishing, sulfate ions from the sulfuric acid may be consumed, which deprives the electrolyte of an important charge carrier and reduces the efficiency of the electropolishing process. Simultaneously, water is evolved as part of the electropolishing process. Depletion of sulfate ions from the electrolyte and accumulation of water can eventually cause the electropolishing electrolyte to become ineffective for electropolishing metal articles.

In one embodiment, the sulfate salt may be substantially insoluble in the electropolishing electrolyte in the absence of water. That is, the sulfate salt may be essentially insoluble in the electrolyte so long as it is in its anhydrous state. However, in the presence of water, such as water evolved in the electropolishing process and/or water absorbed from the atmosphere, the sulfate salt may become at least partially soluble in the electropolishing electrolyte. As such, as water is introduced into the electrolyte as part of the electropolishing process, the sulfate salt can be dissolved into the electrolyte to replenish sulfate ions that are simultaneously being consumed. In another embodiment, the sulfate salt may be an anhydrous metal sulfate salt that can scavenge water from the electropolishing electrolyte by reacting with the water to form a hydrated metal sulfate salt. The hydrated form of the metal sulfate salt may be at least partially soluble in the electrolyte, whereas the anhydrate may be substantially insoluble in the electrolyte.

In another embodiment, a method for scavenging water in an electropolishing electrolyte solution is described. The method includes (1) positioning a substantially anhydrous electropolishing electrolyte solution in an electropolishing apparatus, (2) adding a first quantity of at least one sulfate salt to the substantially anhydrous electropolishing electrolyte solution, wherein the sulfate salt is substantially insoluble in the electropolishing electrolyte solution in absence of water, and (3) electropolishing a metal article in the substantially anhydrous electropolishing electrolyte solution in the electropolishing cell, wherein water evolved during the electropolishing process is capable of solublizing at least a portion of the at least one sulfate salt so as to replenish sulfate ions consumed during the electropolishing.

The methods described herein may further include electropolishing at a substantially constant electrical current while monitoring voltage across the electropolishing cell, and adding a second quantity of the at least one sulfate salt to the electropolishing electrolyte solution when the voltage exceeds a selected value. That is, as water is evolved as a by-product of the electropolishing process or as water is absorbed from the air, the capacity of the sulfate salt to replenish sulfate ions and/or scavenge water may be exceeded. As the water concentration in the electropolishing electrolyte solution increases and the sulfate ion concentration decreases, the observed resistance of the solution may increase as the efficiency of the electropolishing process drops, leading to the need to increase the power in order to maintain a substantially constant current. As such, adding an additional quantity of the at least one sulfate salt may be able to restore the sulfate ion concentrations and/or neutralize the excess water in the electropolishing electrolyte solution and thereby restore the electropolishing electrolyte solution.

These and other objects and features of the present disclosure will become more fully apparent from the following description and appended claims, or may be learned by the practice of the invention as set forth hereinafter.

BRIEF DESCRIPTION OF THE DRAWINGS

To further clarify the above and other advantages and features of the present disclosure, a more particular description of the embodiments of the invention will be rendered by reference to specific embodiments thereof which are illustrated in the appended drawings. It is appreciated that these drawings depict only illustrated embodiments of the disclosure and are therefore not to be considered limiting of its scope. The embodiments of the invention will be described and explained with additional specificity and detail through the use of the accompanying drawings in which.

DETAILED DESCRIPTION

The present disclosure relates to a substantially anhydrous electropolishing electrolyte solution that includes at least one sulfate salt (e.g., a metal sulfate salt). Methods of electropolishing metal articles using such electropolishing electrolyte solutions are disclosed herein as well. The substantially anhydrous electropolishing electrolyte solutions described herein do not use water as a solvent; instead, such electropolishing electrolyte solutions use anhydrous alcohols, glycols, and the like as a solvent. For example, an electropolishing electrolyte solution, as described herein, may include an alcohol, at least one mineral acid, and at least one sulfate salt. In one embodiment, the sulfate salt is capable of replenishing sulfate ions that are consumed during the electropolishing process. In a related embodiment, the sulfate salt may be an anhydrous metal sulfate salt that is capable scavenging water from the electropolishing electrolyte by reacting with the water to form a metal sulfate hydrate. Such a metal sulfate hydrate may also being capable of replenishing sulfate ions. Such electropolishing electrolyte solutions and methods employing such electropolishing solutions may yield better electropolishing efficiency for a given voltage and current, increased longevity of the electropolishing electrolyte solution, and electropolished metal articles having substantially improved surface quality and uniformity.

Figure 1:
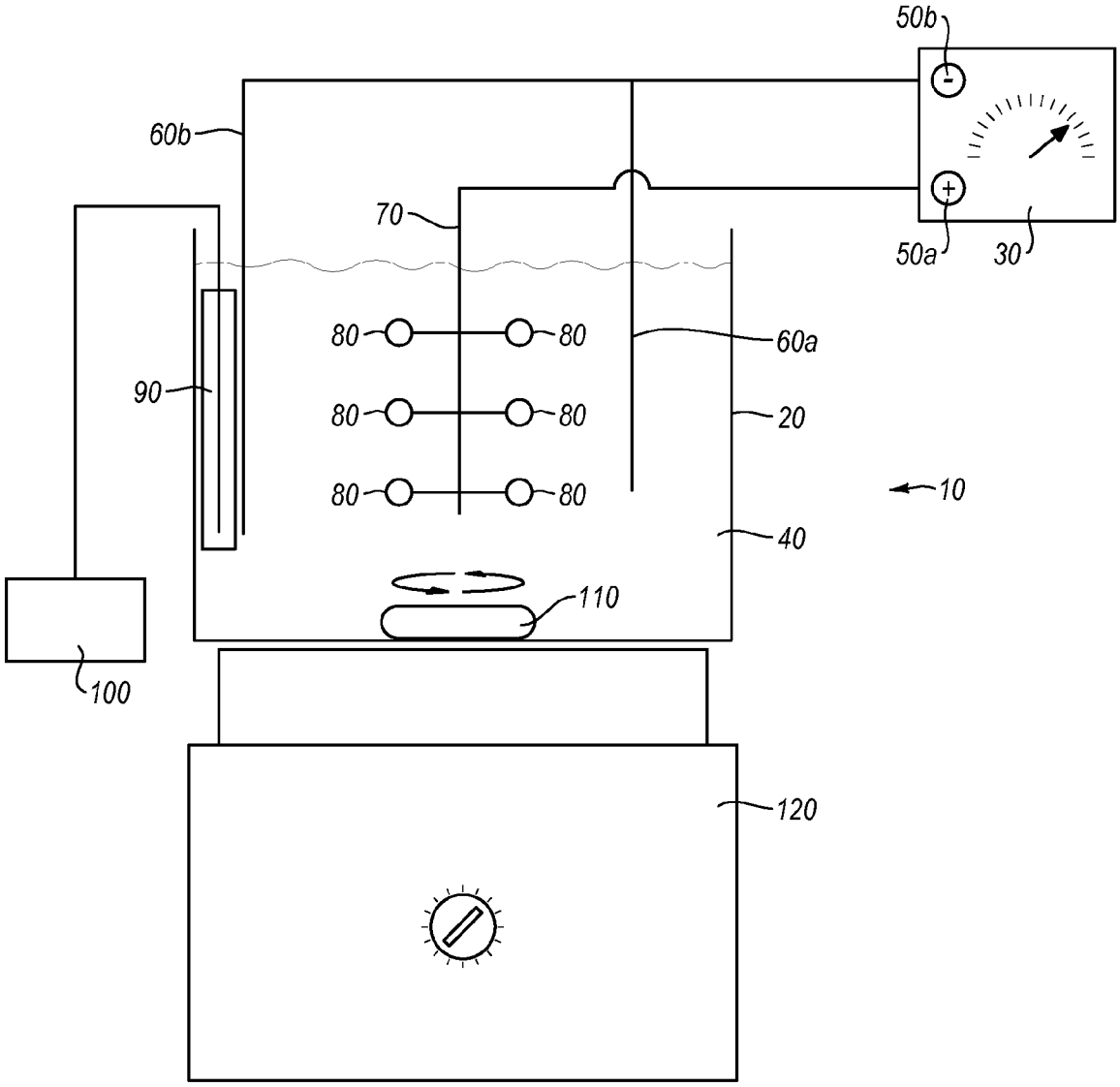
FIG. 1 is a schematic illustrating an electropolishing apparatus suitable for practicing the electropolishing embodiments described herein.

A schematic of a typical electropolishing apparatus 10 suitable for practicing the electropolishing embodiments described herein is illustrated in FIG. 1. The typical electropolishing apparatus 10 includes an electrolyte reservoir 20 that is configured to hold an electropolishing electrolyte solution 40. The typical electropolishing apparatus 10 further includes one or more cathode conductors 60*a* and 60*b*, an anode 70, and a direct current ("DC") power supply 30.

In the typical electropolishing apparatus 10, a number of metal work pieces 80 (e.g., stents) are electrically connected to the anodic (or positive) terminal 50*a* of the power supply 30 via anode 70, while the cathodic (or negative) terminal 50*b* of the power supply 30 is connected to cathodes 60*a* and 60*b*. The anode 70 and the cathode(s) 60*a* and 60*b* are connected to the DC power supply 30 and suspended in the reservoir 20 in the electrolyte solution 40. The anode 70 and the cathode 60*a* and 60*b* are submerged in the solution, forming a complete electrical circuit with the electropolishing electrolyte solution 40. A DC current is applied to the anode 70 and the cathode 60*a* and 60*b* to initiate the electropolishing process.

In the electropolishing methods described herein, for example, electropolishing is carried out with the electropolishing electrolyte solution 40 at or below about 0° C. due at least in part to the fact that the electropolishing process generates heat and the electropolishing electrolyte solution 40 can become unsafe if it is allowed to warm. As such, as further illustrated in FIG. 1, the electropolishing apparatus 10 may also include a combined temperature probe/heating and cooling unit 90, which is attached to a control unit 100. In the illustrated embodiment, the combined temperature probe/heating and cooling unit 90 is submerged in the electropolishing electrolyte solution 40. The control unit 100 may be programmed to monitor and control the temperature of the electropolishing electrolyte solution 40. Other configurations for monitoring/controlling the temperature of the electropolishing electrolyte solution 40 may be used in other embodiments.

The electropolishing apparatus 10 may also include a magnetic stir plate 120 and a magnetic stir bar 110 for mixing the electropolishing electrolyte solution 40 and ensuring even distribution of the electrolyte 40 around the workpieces 80 and the electrodes 60*a*, 60*b*, and 70. Other configurations for mixing the electropolishing electrolyte 40 may be used in other embodiments.

Figure 2A:
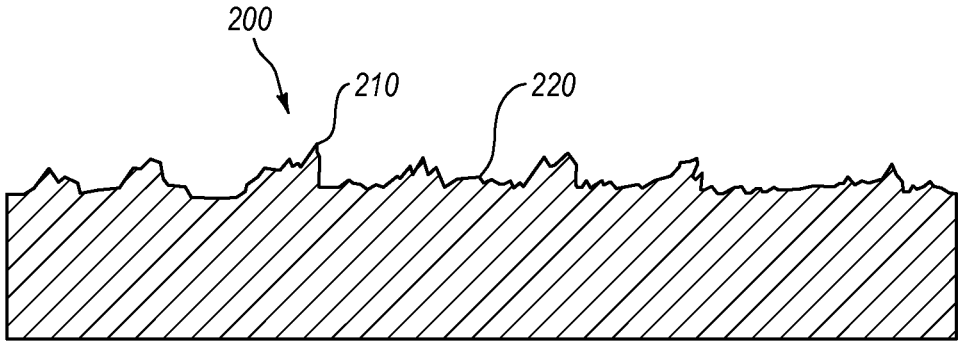
FIGS. 2A and 2B are schematic cross-sectional views illustrating the effect of electropolishing on surface finish.
Figure 2B:
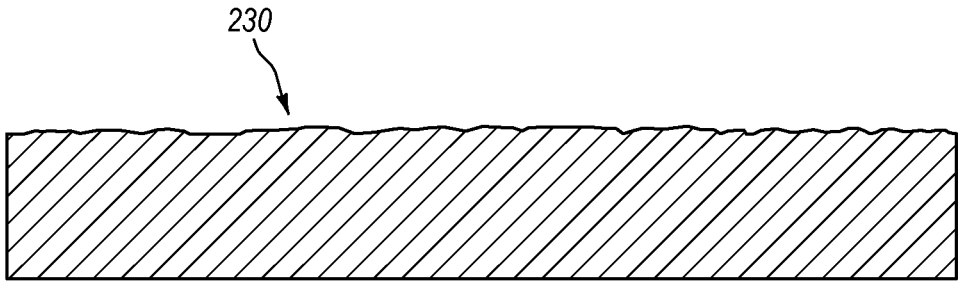

For a given electropolishing electrolyte solution, the quantity of metal removed from the work piece is proportional to the amount of current applied and the time. Other factors, such as the geometry of the work piece, affect the distribution of the current and, consequently, have an important bearing upon the amount of metal removed in local areas. For example, FIGS. 2A and 2B illustrate a surface 200 and 230 before and after electropolishing. Sharp regions, such as burrs and sharp edges, illustrated at 210 in FIG. 2A have higher current density than smoother areas illustrated at 220, which leads to the preferential removal of material from the sharp regions 210 and relatively little material removal from the smoother regions. The principle of differential rates of metal removal is important to the concept of deburring accomplished by electropolishing. Fine burrs have very high current density and are, as a result, rapidly dissolved. Smoother areas have lower current density and, as a result, less material is removed from these areas. The result of electropolishing is illustrated in FIG. 2B. As can be seen, the sharp regions illustrated at 210 in FIG. 2A are eroded away leaving a substantially flat, defect free surface 230.

In the course of electropolishing, the work piece is manipulated to control the amount of metal removal so that polishing is accomplished and, at the same time, dimensional tolerances are maintained. Electropolishing literally dissects the metal crystal atom by atom, with rapid attack on the high current density areas and lesser attack on the low current density areas. For most materials, the result is an overall reduction of the surface profile with a simultaneous smoothing and brightening of the metal surface.

Electropolishing produces a number of favorable changes in a metal work piece (e.g., a stent). These favorable changes include, but are not limited to, one or more of:

Brightening
Burr removal
Oxide and tarnish removal
Reduction in surface profile
Removal of surface occlusions
Increased corrosion resistance
Improved adhesion in subsequent plating
Removal of directional lines
Radiusing of sharp edges, sharp bends, and corners
Reduced surface friction
Stress relieved surface

Electropolishing Electrolyte Solutions

In one embodiment, an electropolishing electrolyte solution is described. The electropolishing electrolyte solution includes an alcohol, at least one mineral acid, and at least one sulfate salt. The at least one sulfate salt may be added in a quantity sufficient to replenish sulfate ions that are consumed in the electropolishing process. The at least one sulfate salt may also be added as an anhydride salt or a low order hydrate such that the sulfate salt can react with water in the electropolishing electrolyte to form a hydrate and thereby effectively scavenge water from the electrolyte. Such an anhydride or hydrate may be selected such that it is capable of replenishing sulfate ions that are consumed in the electropolishing process. Similarly, such an anhydride sulfate salt may be used primarily for its water sequestering ability while another, more soluble sulfate salt is also added to the electropolishing electrolyte to replenish sulfate ions that are consumed in the electropolishing process.

In one embodiment, the at least one mineral acid may include about 3 volume % ("vol %") to 12 vol % sulfuric acid and about 0 vol % to about 30 vol % methanolic HCl; or about 6 vol % to 9 vol % sulfuric acid and about 7 vol % to about 28 vol % methanolic HCl; or about 6 vol % to 9 vol % sulfuric acid and about 12 vol % to about 20 vol % methanolic HCl. In another embodiment, the at least one mineral acid includes about 5 vol % to about 7 vol % sulfuric acid and about 3 vol % to about 14 vol % methanolic hydrochloric acid.

Conventional hydrochloric acid is made by dissolving hydrogen chloride gas in water. Most commercially available concentrated hydrochloric acid contains about 38 vol % of hydrogen chloride dissolved in water. The hydrochloric acid used in the electropolishing electrolyte solutions described herein is different. Instead of dissolving hydrogen chloride gas in water, the concentrated hydrochloric acid used herein is essentially anhydrous due to the fact that the hydrogen chloride gas is dissolved in methanol. Such acid is generally referred to as methanolic hydrochloric acid or methanolic HCl. Methanolic HCl is available commercially in a 3N solution. Hydrogen chloride gas can also be dissolved in other alcohols such as, but not limited to, ethanol and 2-propanol. Commercially available concentrated sulfuric acid is approximately 18.4 molar and is typically 95-98% pure. In a specific embodiment, the sulfuric acid (98%) is 18.4 M prior to mixing, which is diluted to 1.19 M once mixed in the final solution and the methanolic HCl is 3N prior to mixing, which is diluted to 0.42 M once mixed in the final solution. Electropolishing electrolytes containing other acids and acid mixtures depending on the metal or metals being electropolished.

In a one embodiment, the electropolishing electrolyte solution includes about 79.5 vol % methanol, about 14 vol % concentrated methanolic hydrochloric acid, about 6.5 vol % concentrated sulfuric acid, and at least one sulfate salt. Suitable examples of sulfate salts include, but are not limited to, ammonium sulfate ($(NH_4)_2SO_4$), sodium sulfate ($Na_2SO_4$), zinc sulfate ($ZnSO_4$), potassium sulfate ($K_2SO_4$), calcium sulfate ($CaSO_4$), and magnesium sulfate ($MgSO_4$). In one example, approximately 20 g of magnesium sulfate can be added to approximately 2000 ml of electropolishing electrolyte solution.

Of sulfates listed above, all except $(NH_4)_2SO_4$ can exist in an anhydride form and at least one hydrated form. For example, anhydrous sodium sulfate readily converts to a decahydrate ($Na_2SO_4.10H_2O$) when exposed to water. Zinc sulfate forms multiple hydrates: $ZnSO_4.7H_2O$ is most common, while lower order hydrates, such as $ZnSO_4.6H_2O$, $ZnSO_4.4H_2O$, and $ZnSO_4.H_2O$, are also known Anhydrous $CaSO_4$ is not reactive toward water; however, calcium sulfate hemihydrate ($CaSO_4.½H_2O$) readily hydrates to $CaSO_4.2H_2O$. Anhydrous magnesium sulfate readily converts to a heptahydrate ($MgSO_4.7H_2O$) when exposed to water.

Ammonium sulfate and sodium sulfate are highly soluble in water but practically insoluble in alcohols. Zinc sulfate is highly soluble in both water and alcohols. Potassium sulfate and magnesium sulfate are highly soluble in water and slightly soluble in alcohols. Calcium sulfate, regardless of hydration state, is practically insoluble in both water and alcohols.

In one embodiment, the sulfate salt included in the electropolishing electrolyte is magnesium sulfate. For example, about 5 g to about 100 g of magnesium sulfate per approximately 1000 ml of the electropolishing electrolyte solution. In one embodiment, about 5 g to about 50 g magnesium sulfate can be added to approximately 1000 ml of the electropolishing electrolyte solution. In another embodiment, about 10 g to about 20 g magnesium sulfate can be added to approximately 1000 ml of the electropolishing electrolyte solution. Similar quantities of the other sulfates described herein may be added in lieu of or with the magnesium sulfate.

Because the sulfates described herein may go into solution slowly as water is introduced into the electropolishing solution, the practical upper limit of the amount of sulfate salt that can be added is limited only by need to maintain a sufficient liquid volume to electropolish the metal articles. In contrast, on the lower end, a sufficient amount of the sulfate salt needs to be added to the electropolishing solution to replenish sulfate ions that are depleted as the solution is used in order to prolong the life of the solution and thereby increase the number of metal articles that can be electropolished without having to change the solution.

For example, by increasing the electrolyte longevity, less hazardous waste may be produced. That is, the used electropolishing electrolyte solution may be classified as hazardous waste and increasing the useful life of the electrolyte reduces the amount of electrolyte that has to be disposed of Likewise, increasing the electrolyte longevity can lead to an overall increase in manufacturing efficiency. This is due at least in part to the fact that the electrolyte needs changed less frequently. In addition, because the electropolishing electrolyte solution is more effective, a better surface finish may be obtained at more rapid erosion rates if sulfate levels are maintained and/or the effects of water contamination are mitigated.

The electropolishing electrolyte solutions described herein are basically a mixture of sulfuric acid ($H_2SO_4$), which provides the sulfate ions and some of the hydrogen ions, hydrochloric acid (HCl), which provides the additional hydrogen ions, and methanol as the solvent. Under electropolishing conditions (i.e., high voltage and high current), these electropolishing electrolyte solutions are able to electropolish tantalum and tantalum alloys. For example, tantalum is removed from the solid metal structure according to the following reaction:

$$3SO_4^{-2}+12H^+ +2Ta \rightarrow 3H_2SO_3+3H_2O+2Ta^{+3} \qquad \text{Formula 1}$$

As can be seen from Formula 1, sulfate ions ($SO_4^{-2}$) and hydrogen ions ($H^+$) are consumed in the process of electropolishing tantalum. As a result, the conductivity of the current electropolishing electrolyte solution decreases as the electrolyte is used, requiring more energy to be required to drive the electropolishing process. As the electropolishing electrolyte becomes less effective due to the depletion of $SO_4^{-2}$ and $H^+$ the quality of the articles that are electropolished can be reduced. In addition, increasing the amount of energy needed to drive the electropolishing reaction will tend to cause the temperature of the electrolyte temperature to rise. Since methanol produces flammable/explosive fumes, the electrolyte is actively cooled to less than about 0° C. (e.g., about −8° C.) to prevent a significant temperature rise and reduce the amount of ethanol that becomes fumes and thus, reduce the flammable/explosive hazard.

Still referring to Formula 1, it can also be seen that water is evolved in the electropolishing process at essentially the same rate that $SO_4^{-2}$ is consumed. In addition, alcohol solutions are naturally hygroscopic (meaning that they will draw water out of humid air) and the electropolishing electrolyte solutions described herein are typically chilled below the dew point of atmospheric water while in use, which can further lead to the condensation of water in the electropolishing electrolyte solution. Nevertheless, the electropolishing electrolyte solution described herein is preferably anhydrous or at least substantially anhydrous. This is due to the fact that water can poison the electropolishing solution and reduce the ability of the solution to electropolish metal articles. This, coupled with the depletion of sulfate ions, can eventually render the electropolishing electrolyte solutions ineffective for electropolishing metal articles.

For example, when electropolishing articles fabricated from tantalum or a tantalum alloy (e.g., stent 400 or closure element 430 described in detail below), water is capable of poisoning the electropolishing solution because, under electropolishing conditions, tantalum can react with water to form an insulating oxide layer on the surface of the tantalum metal article. In addition, under electropolishing conditions (i.e., high voltage and high current), water can be broken down by electrolysis or other electrochemical processes to create gas bubbles that can adhere to the material being electropolished. Since the electropolishing reaction generally cannot occur through the gas bubbles, the surface quality (smoothness) of the electropolished article can be compromised.

Thus, when a critical amount of water is introduced into the electropolishing electrolyte solution and/or a critical amount of charge carriers are lost, the ability of the solution to electropolish tantalum and tantalum alloys may be deactivated. However, the lifespan of the electropolishing electrolyte solution can be extended or a deactivated electropolishing electrolyte solution can be reactivated by adding at least one sulfate salt to the electrolyte. Many sulfate salts are practically insoluble in alcohol but are quite soluble in the presence of water. As a result, a quantity of the at least one sulfate salt can be added to the electropolishing electrolyte to act as a reservoir of sulfate ions that can come into solution to replenish consumed sulfate ions as water is evolved. And since water is evolved at essentially the same rate that sulfate is consumed (see, e.g., Formula 1), sulfate can essentially be replaced at or near the rate that it is consumed.

In addition, if the at least one sulfate salt is added to the electropolishing electrolyte in an anhydrous form, it can help to maintain and/or restore the anhydrous nature of the electropolishing electrolyte solution by reacting to form a sulfate salt hydride with water that is introduced into the electropolishing solution. Generally speaking, sulfate salt hydrates are more soluble in alcohol than their anhydride forms, which can allow the sulfate ions to enter solution as water is evolved.

In one embodiment, an excess of a water scavenging but insoluble sulfate salt (e.g., calcium sulfate hemihydrate ($CaSO_4.½H_2O$), which readily hydrates to $CaSO_4.2H_2O$) can be added to scavenge water, while a second, more soluble sulfate salt (e.g., $(NH_4)_2SO_4$ or $MgSO_4.7H_2O$) can be added to serve as a source of sulfate ions.

In another embodiment, a sulfate salt that can act as a source of sulfate ions can be used in combination with the water scavenging agent phosphorous pentoxide ("$P_2O_5$"). $P_2O_5$, which is normally insoluble in the electropolishing electrolyte, is able to chemically eliminate water from the electropolishing electrolyte by reacting with water to produce phosphoric acid. Producing phosphoric acid in situ with $P_2O_5$ has an added benefit in that phosphoric acid can replenish $H^+$ ions that are depleted in the electropolishing process.

Electropolishing Methods

In another embodiment, a method for scavenging water in an electropolishing electrolyte solution is described. The method includes (1) positioning a substantially anhydrous electropolishing electrolyte solution in an electropolishing apparatus, (2) adding a first quantity of at least one sulfate salt to the substantially anhydrous electropolishing electrolyte solution, wherein the sulfate salt is substantially insoluble in the electropolishing electrolyte solution in absence of water, and (3) electropolishing a metal article in the substantially anhydrous electropolishing electrolyte solution in the electropolishing cell, wherein water evolved during the electropolishing process is capable of solublizing at least a portion of the at least one sulfate salt so as to replenish sulfate ions consumed during the electropolishing.

In yet another embodiment, a method for electropolishing an implantable medical device fabricated from a tantalum alloy is described. The method includes (1) positioning a substantially anhydrous electropolishing electrolyte solution in an electropolishing cell, wherein the electropolishing cell includes a reservoir configured to contain the substantially anhydrous electropolishing electrolyte solution, an anode and a cathode suspended in the electrolyte and connected to an electrical power supply, (2) adding a first quantity of at least one anhydrous metal sulfate salt to the substantially anhydrous electropolishing electrolyte solution, wherein the at least one anhydrous metal sulfate salt is substantially insoluble in the electropolishing electrolyte solution in absence of water, (3) connecting a metal article to an anode and positioning the metal article in the reservoir in the substantially anhydrous electropolishing electrolyte solution, and (4) running an electrical current through the substantially anhydrous electropolishing electrolyte solution via the anode and the cathode so as to electropolish the implantable medical device, wherein water evolved during the electropolishing reacts with the at least one anhydrous metal sulfate salt to form at least one metal sulfate hydrate. As explained above, formation of the hydrate can scavenge water from the electrolyte. In addition, the hydrated metal sulfate salt is at least partially soluble in the electrolyte, such that the sulfate salt can dissolve and replenish sulfate ions consumed in the electropolishing.

The methods described herein may further include electropolishing at a substantially constant electrical current while monitoring voltage across the electropolishing cell, and adding a second quantity of the at least one sulfate salt to the electropolishing electrolyte solution when the voltage exceeds a selected value. That is, as water is evolved as a by-product of the electropolishing process or as water is absorbed from the air, the capacity of the sulfate salt to replenish sulfate ions and/or scavenge water may be exceeded. As the water concentration in the electropolishing electrolyte solution increases and the sulfate ions concentration decreases, the observed resistance of the solution may increase as the efficiency of the electropolishing process drops, leading to the need to increase the voltage in order to maintain a substantially constant current. As such, adding an additional quantity of the at least one sulfate salt may be able to restore the sulfate ion concentrations and/or neutralize the excess water in the electropolishing electrolyte solution and thereby restore the electropolishing electrolyte solution.

The methods described herein may employ any of the electropolishing electrolyte solutions described herein. For example, the electropolishing electrolyte solution may include about 5 volume % ("vol %") to about 7 vol % sulfuric acid and about 3 vol % to about 14 vol % methanolic hydrochloric acid. The electropolishing electrolyte solution may further include at least one water sequestering agent, as described in detail elsewhere herein.

EXAMPLES

Working Example 1

An electropolishing electrolyte solution may be prepared in the following manner:

1. Turn on chiller, wait until temperature is below 0° C.
2. Cool methanol at least 3 hours prior to mixing.
3. Measure 1600 mL of Methanol and place it in a double-walled beaker that is attached to the chiller.
4. Put a thermometer into the beaker to measure solution temperature. The temperature must be below 0° C. before proceeding to the next step.
5. Measure 130 ml of sulfuric acid and slowly pour the acid into the beaker along the edge, then stir to mix the acid thoroughly with the methanol.

Note: if temperature of solution rise above 10° C., stop adding the acid and wait for the temperature to drop below 0° C.

6. Measure 282 ml of methanolic HCl and slowly pour into the beaker along the edge. Stir solution until a vortex is formed to mix thoroughly.
7. Add approximately 20 g of magnesium sulfate with the solution prepared in steps 1-6.
8. Pour the mixture into a storage container, close cap securely and store in refrigerator.

Working Example 2

Stents are typically electropolished at a control current a range of 1-5 Amps for 3-4 cycles of 4-12 seconds per cycle. However, these parameters are dependent on the size of the stent, how much material is removed from the stent, etc. The temperature of the electrolyte during electropolishing is kept between −10 and +5 degrees Celsius. Additional sulfate salt (e.g., $MgSO_4$ or $Na_2SO_4$) can be added at regular intervals during the electropolishing or as visual inspection of the electropolished articles indicates declining electropolishing quality.

Working Example 3

Using the electropolishing electrolyte prepared in Example 1, tantalum alloy stents could be electropolished at a current of about 2 amps and a voltage of about 9-10 volts. In contrast, an electropolishing electrolyte lacking magnesium sulfate started with a current of about 2 amps and a voltage of about 9-10 volts, but the voltage quickly rose to undesirable/unsafe levels above about 11 volts. In addition, when magnesium sulfate powder was added to the electrolyte, the generated voltage at 2 amps dropped to 9-10 volts. This illustrates the positive impact on conductivity produced by the addition the magnesium sulfate to the electrolyte.

At least two positive effects have been noted with the use of magnesium sulfate and other sulfate salts. First, since the conductivity of the electrolyte is increased, there is a longer mean time between electrolyte replacements. This is because it will generally take longer for the electrolyte conductivity to reach a critical point of being ineffective (critical drop in consumed ion concentration) and/or producing a poor surface finish. This is generally true even if water is accumulating in the electrolyte. Although, as described herein, anhydrous sulfate salts can also be used to control water accumulation in the electrolyte. Second, stents polished with this electrolyte have been qualitatively assessed and determined to have improved surface finish compared to the electrolyte that does not contain magnesium sulfate. This improvement to surface finish can benefit clinical outcome.

Figure 3A:
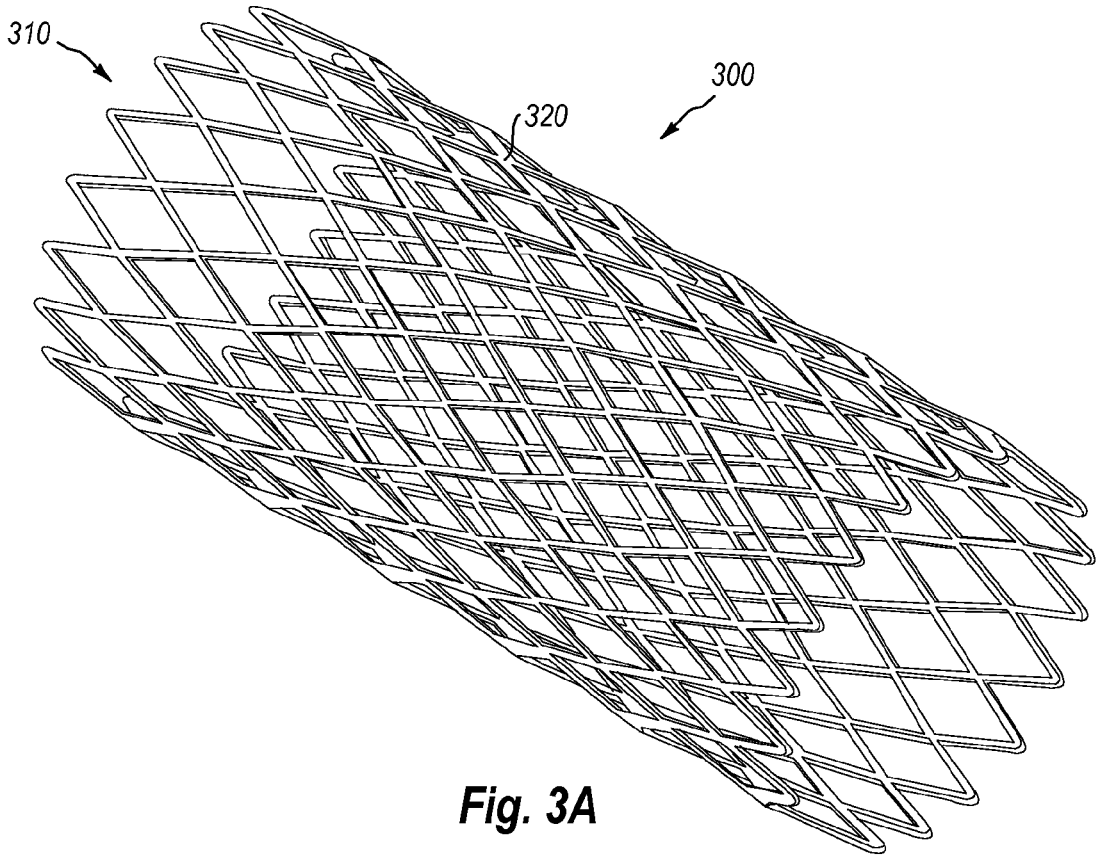
FIG. 3A is an isometric view of a stent made from a tantalum alloy according to an embodiment of the present disclosure.

Tantalum-Alloy Products, Such as Stents and Other Implantable Medical Devices As discussed above, the disclosed electropolishing solutions and methods are particularly suitable for electropolishing tantalum-based articles, such as stents. FIG. 3A is an isometric view of a stent 300 made from a tantalum alloy according to an embodiment of the present disclosure. The stent 300 includes a stent body 310 sized and configured to be implanted and deployed into a lumen of a living subject. The stent body 310 may be defined by a plurality of interconnected struts 320 configured to allow the stent body 310 to radially expand and contract. However, it is noted that the illustrated configuration for the stent body 310 is merely one of many possible configurations, and other stent-body configurations made from the inventive tantalum-alloy products disclosed herein are encompassed by the present disclosure. For example, the struts 320 may be integrally formed with each other as shown in the illustrated embodiment, separate struts may be joined together by, for example, welding or other joining process, or separate stent sections may be joined together.

The stent body 310 is made from a tantalum alloy that is composed and heat-treated to obtain one or more of certain desirable microstructural, mechanical, or chemical properties. For example, the tantalum alloy may be heat treated to modify at least one mechanical property thereof, such as ductility, yield strength, or ultimate tensile strength. It has been found that a tantalum alloy that includes tantalum, niobium, and at least one additional element selected from the group consisting of tungsten, zirconium, molybdenum, and/or at least one of hafnium, rhenium, and cerium can fulfill the mechanical and biocompatibility requirements needed for functioning as in a medical device.

The tantalum alloy includes a tantalum content of about 78 weight-percent ("wt %") to about 91 wt %, a niobium content of about 7 wt % to about 12 wt %, and a tungsten content of about 1 wt % to about 10 wt %. However, the tantalum alloy may also include other alloying elements, such as one or more grain-refining elements in an amount up to about 5 wt % of the tantalum alloy. For example, the one or more grain-refining elements may include at least one of hafnium, cerium, or rhenium. Tungsten is provided to solid-solution strengthen tantalum, and niobium is provided to improve the ability of tantalum to be drawn. The tantalum alloy is a substantially single-phase, solid-solution alloy having a body-centered cubic crystal structure. However, some secondary phases may be present in small amounts (e.g., inclusions) depending upon the processing employed to fabricate the tantalum alloy.

The composition of the tantalum alloy may be selected from a number of alloy compositions according to various embodiments. In an embodiment, the niobium content is about 9 wt % to about 10.5 wt %, the tungsten content is about 6.0 wt % to about 8 wt %, and the balance may include tantalum (e.g., the tantalum content being about 80 wt % to about 83 wt %) and, if present, other minor alloying elements and/or impurities. In a more detailed embodiment, the niobium content is about 10 wt %, the tungsten content is about 7.5 wt %, and the balance may include tantalum (e.g., the tantalum content being about 82.5 wt %) and, if present, other minor alloying elements and/or impurities. In another more detailed embodiment, the niobium content is about 10 wt %, the tungsten content is about 2.5 wt %, and the balance may include tantalum (e.g., the tantalum content being about 87.5 wt %) and, if present, other minor alloying elements and/or impurities.

In another embodiment, the niobium content is about 10.5 wt % to about 13 wt %, the tungsten content is about 5.0 wt % to about 6 wt %, and the balance may include tantalum (e.g., the tantalum content being about 80 wt % to about 82 wt %) and, if present, other minor alloying elements and/or impurities. In a more detailed embodiment, the niobium content is about 12.5 wt %, the tungsten content is about 5.8 wt %, and the balance may include tantalum (e.g., the tantalum content being about 81 wt % to about 81.5 wt %) and, if present, other minor alloying elements and/or impurities.

In a specific example, the tantalum-containing refractory metal article disclosed herein may be made from a tantalum alloy that includes about 82.5 weight percent tantalum, about 10 weight percent niobium, and about 7.5 weight percent tungsten.

In another specific example, the tantalum-containing refractory metal article disclosed herein may be made from a tantalum alloy that includes about 87.5 weight percent tantalum, about 10 weight percent niobium, and about 2.5 weight percent tungsten.

In an embodiment, the tantalum alloy may exhibit a grain microstructure including recrystallized, generally equiaxed grains characteristic of being formed by heat treating a precursor product of the stent body 310 or the stent body 310 itself, both of which may be severely plastically deformed in a drawing process. Depending upon the extent of recrystallization process, the grain microstructure may be only partially recrystallized. In some embodiments, the recrystallization process may substantially completely recrystallize the grain microstructure with the new recrystallized grains having consumed substantially all of the old deformed grains. Even when the grain microstructure is partially recrystallized, it will be apparent from microstructural analysis using optical and/or electron microscopy that the grain microstructure includes some recrystallized grains having, for example, a generally equiaxed geometry. An average grain size of the tantalum alloy may be about 10 μm to about 20 μm and, more particularly, about 13 μm to about 16 μm depending on the extent of recrystallization and the amount of the optional one or more grain-refining alloy elements in the tantalum alloy.

In other embodiments, the tantalum alloy may be stress relieved at a temperature below a recrystallization temperature of the tantalum alloy so that the grain microstructure is relatively unchanged from the as-drawn condition. Thus, in the stress-relieved condition, the grain microstructure may include essentially only non-equiaxed, deformed, cold-worked grains. However, the stress-relief heat treatment may at least partially remove at least one of hydrogen, oxygen, or oxygen from the tantalum alloy, which can detrimentally embrittle the tantalum alloy. Thus, the tantalum alloy in the stress-relieved condition may exhibit an improved ductility relative to the as-drawn condition, while the tensile yield strength and tensile ultimate tensile strength are generally unaffected by the stress-relief heat treatment.

The disclosed heat-treated tantalum alloys are sufficiently radiopaque and stronger (e.g., greater yield strength) than substantially pure tantalum (e.g., commercially pure tantalum). Consequently, the struts 320 of the stent body 310 may be thinner in a radial direction than a stent made from substantially pure tantalum and having a similar configuration, while still providing the same, better, or adequate imaging characteristics under X-ray fluoroscopy and MRI. Commercially pure tantalum exhibits a relatively greater radiopacity.

However, since commercially pure tantalum is much weaker than the tantalum alloys disclosed herein, a stent made from commercially pure tantalum typically could be excessively thick for structural reasons thereby resulting in the stent being excessively radiopaque and making it difficult to distinguish surrounding body tissue during imaging.

Referring still to FIG. 3A, for example, an average thickness "t" of the struts 320 of the stent body 310 in a radial direction may be about 40 μm to about 100 lam, about 60 μm to about 80 μm, about 50 μm to about 90 μm, about 50 μm to about 77 μm, about 53 μm to about 68.5 μm, or about 58 μm to about 63.5 μm, while also exhibiting the desirable disclosed combination of strength, ductility, and radiopacity as discussed hereinabove. Because the disclosed heat-treated tantalum alloys are sufficiently strong as characterized by yield strength, ultimate tensile strength, radial strength, or combinations of the foregoing mechanical properties, the average thickness "t" of the struts 320 of the stent body 310 may be made sufficiently thin to help reduce vessel injury and enhance deliverability while still having a sufficient radiopacity to be visible in X-ray fluoroscopy and MRI.

In one or more embodiments, the stent body 310 may be etched in an acid (e.g., hydrofluoric acid) to remove heat-affected zones associated with forming the struts 320 via laser cutting and/or electropolished to improve a surface finish of the stent body 310. In such embodiments, the stent body 310 may be heat treated (e.g., a stress-relief heat treatment or recrystallization heat treatment) so that at least one of hydrogen, oxygen, or nitrogen introduced to the tantalum alloy from the acid and/or the electropolishing solution is at least partially removed. Following heat treatment, the stent body 310 may include one or more etched and/or one or more electropolished surfaces, and the tantalum alloy that forms the stent body 310 may substantially free of at least one of hydrogen, oxygen, or nitrogen or include at least one of hydrogen, oxygen, or nitrogen in an amount below a threshold concentration sufficient to cause environmental cracking in the tantalum alloy, such as hydrogen that causes hydrogen embrittlement. For example, oxygen may be present in the tantalum alloy in a concentration of about 400 ppm or less (e.g., about 100 ppm to about 300 ppm) without causing embrittlement.

Figure 3B:
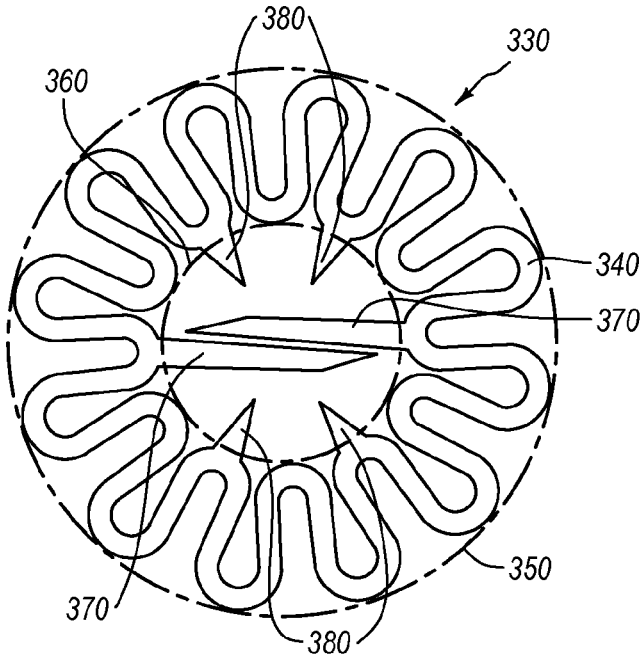
FIG. 3B is a plan view of a closure element made from any of the tantalum alloys disclosed herein according to an embodiment of the present disclosure.

Other implantable medical devices besides stents may employ a tantalum alloy exhibiting one or more of the disclosed tailored properties, such as guide wires, closure elements, pacemaker leads, orthopedic devices, embolic coils, sutures, prosthetic heart valves, mitral valve repair coils, or other medical devices or portions thereof for deploying the foregoing medical devices. For example, FIG. 3B illustrates a closure element 330 (e.g., a staple) made from any of the heat-treated tantalum alloys disclosed herein. The closure element 330 includes a body 340 defining an outer perimeter 350, an inner perimeter 360, primary tines 370, and secondary tines 380.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A method for replenishing sulfate ions in situ in an electropolishing electrolyte solution, the method comprising:

positioning a substantially anhydrous electropolishing electrolyte solution in an electropolishing cell;

adding a first quantity of at least one sulfate salt to the substantially anhydrous electropolishing electrolyte solution, wherein the at least one sulfate salt is substantially insoluble in the electropolishing electrolyte solution in absence of water;

electropolishing a metal article in the substantially anhydrous electropolishing electrolyte solution in the electropolishing cell at a substantially constant electrical current while monitoring voltage across the electropolishing cell, wherein water evolved during the electropolishing process is capable of solubilizing at least a portion of the at least one sulfate salt so as to replenish sulfate ions consumed during the electropolishing; and adding a second quantity of the at least one sulfate salt to the electropolishing electrolyte solution when the voltage exceeds a selected value.

2. The method of claim 1, wherein the first quantity of the at least one sulfate salt is an anhydrous metal sulfate salt.

3. The method of claim 2, wherein the anhydrous metal sulfate is capable of scavenging water from the electropolishing electrolyte solution by reacting with the water to form a hydrated metal sulfate.

4. The method of claim 3, wherein the hydrated metal sulfate is more soluble in the electropolishing electrolyte solution than the anhydrous metal sulfate.

5. The method of claim 1, wherein the substantially anhydrous electropolishing electrolyte solution includes about 5 volume % ("vol %") to about 7 vol % sulfuric acid and about 3 vol % to about 14 vol % methanolic hydrochloric acid.

6. The method of claim 1, wherein the substantially anhydrous electropolishing electrolyte solution comprises:

about 79.5 vol % methanol;

about 14 vol % concentrated methanolic hydrochloric acid;

about 6.5 vol % concentrated sulfuric acid; and about 5 g to about 100 g of magnesium sulfate per approximately 1000 ml of the electropolishing electrolyte solution.

7. The method of claim 1, wherein the metal article is an implantable stent fabricated from a tantalum alloy.

8. The method of claim 7, wherein the tantalum alloy comprises:

about 75 to about 80 weight percent tantalum;

about 8 to about 12 weight percent niobium; and about 2 to about 10 weight percent tungsten.

9. A method for electropolishing an implantable medical device fabricated from a tantalum alloy, comprising:

positioning a substantially anhydrous electropolishing electrolyte solution in an electropolishing cell, wherein the electropolishing cell includes a reservoir configured to contain the substantially anhydrous electropolishing electrolyte solution, an anode and a cathode suspended in the electrolyte and connected to an electrical power supply;

adding a first quantity of at least one anhydrous metal sulfate salt to the substantially anhydrous electropolishing electrolyte solution, wherein the at least one anhydrous metal sulfate salt is substantially insoluble in the electropolishing electrolyte solution in absence of water;

connecting a metal article to an anode and positioning the metal article in the reservoir in the substantially anhydrous electropolishing electrolyte solution;

running an electrical current through the substantially anhydrous electropolishing electrolyte solution via the anode and the cathode so as to electropolish the implantable medical device at a substantially constant electrical current while monitoring voltage across the electropolishing cell, wherein water evolved while electropolishing the implantable medical device reacts with the at least one anhydrous metal sulfate salt to form at least one metal sulfate hydrate; and adding a second quantity of the at least one anhydrous metal sulfate salt to the electropolishing electrolyte solution when the voltage exceeds a selected value.

10. The method of claim 9, wherein the metal sulfate hydrate is capable of dissolving in the electropolishing electrolyte so as to replenish sulfate ions consumed while electropolishing the implantable medical device.

11. The method of claim 9, wherein the at least one anhydrous metal sulfate salt includes at least one of magnesium sulfate or sodium sulfate.

12. The method of claim 9, wherein the substantially anhydrous electropolishing electrolyte solution includes about 5 volume % ("vol %") to about 7 vol % sulfuric acid and about 3 vol % to about 14 vol % methanolic hydrochloric acid.

13. The method of claim 9, wherein the substantially anhydrous electropolishing electrolyte solution comprises:

about 79.5 vol % methanol;

about 14 vol % concentrated methanolic hydrochloric acid;

about 6.5 vol % concentrated sulfuric acid; and about 5 g to about 100 g of magnesium sulfate per approximately 1000 ml of the electropolishing electrolyte solution.

14. The method of claim 9, wherein the tantalum alloy comprises:

about 75 to about 80 weight percent tantalum;

about 8 to about 12 weight percent niobium; and about 2 to about 10 weight percent tungsten.

* * * * *